US010166551B2

(12) United States Patent
Feraud et al.

(10) Patent No.: US 10,166,551 B2
(45) Date of Patent: Jan. 1, 2019

(54) CENTRIFUGE MACHINE HAVING AN IMPROVED DISCHARGE SYSTEM

(71) Applicants: COMMISSARIAT A L'ENERGIE ATOMIQUE ET AUX ENERGIES ALTERNATIVES, Paris (FR); FLOWERSEP, La Farlede (FR)

(72) Inventors: Jean-Pierre Feraud, Orange (FR); David Chezaud, Lacepede (FR); Joel Robin, La Farlede (FR); Tojonirina Randriamanantena, Bagnols sur Ceze (FR)

(73) Assignees: COMMISSARIAT A L'ENERGIE ATOMIQUE ET AUX ENERGIES ALTERNATIVES, Paris (FR); FLOWERSEP, La Farlede (FR)

( * ) Notice: Subject to any disclaimer, the term of this patent is extended or adjusted under 35 U.S.C. 154(b) by 0 days.

(21) Appl. No.: 15/129,428

(22) PCT Filed: Mar. 26, 2015

(86) PCT No.: PCT/EP2015/056506
§ 371 (c)(1),
(2) Date: Sep. 27, 2016

(87) PCT Pub. No.: WO2015/144802
PCT Pub. Date: Oct. 1, 2015

(65) Prior Publication Data

US 2017/0173597 A1 Jun. 22, 2017

(30) Foreign Application Priority Data

Mar. 28, 2014 (FR) ..... 14 52736

(51) Int. Cl.
*B04B 11/04* (2006.01)
*B04B 1/14* (2006.01)
(Continued)

(52) U.S. Cl.
CPC ..... *B04B 11/04* (2013.01); *B04B 1/14* (2013.01); *B04B 11/05* (2013.01); *B04B 11/06* (2013.01); *B04B 11/00* (2013.01)

(58) Field of Classification Search
CPC ..... B04B 11/00; B04B 11/04; B04B 11/05; B04B 11/06
(Continued)

(56) References Cited

U.S. PATENT DOCUMENTS 2,820,589 A * 1/1958 Fitzsimmons ..... B04B 1/18 494/30
2,911,140 A 11/1959 Johnson
(Continued)

FOREIGN PATENT DOCUMENTS

BR 8605279 A 5/1988
FR 1516026 3/1968
(Continued)

OTHER PUBLICATIONS

International Search Report dated Jun. 16, 2015, in PCT/EP15/56506 filed Mar. 26, 2015. French Preliminary Search Report dated Jan. 13, 2015, in French Application No. 14 52736 filed Mar. 28, 2014.

*Primary Examiner* — Walter D. Griffin
*Assistant Examiner* — Shuyi S. Liu
(74) *Attorney, Agent, or Firm* — Oblon, McClelland, Maier & Neustadt, L.L.P.

(57) ABSTRACT

In a centrifugal machine, collecting chambers, which are in a rotary bowl allocated to centrifugal separation of at least two phases, include a discharge port that can be opened or closed as desired by pistons, movement of which is controlled from outside by a reduced-friction system. Drawing volume is adjustable and proportional to volume of a transverse aperture in the pistons, the ports and the openings of the collecting chambers being offset. The machine enables
(Continued)

Figure 1:
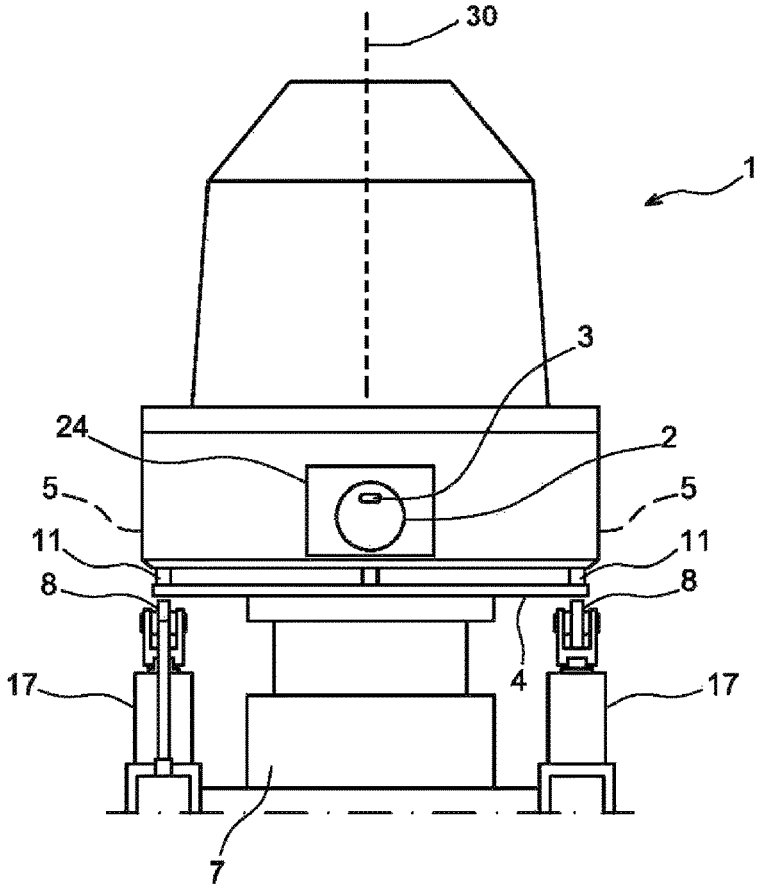

pseudo-continuous drawing which makes it possible to maintain a continuous supply. The drawing volume, composition of the drawn product, and compactness thereof, in a case of a near-solid phase, are controlled.

6 Claims, 3 Drawing Sheets

(51) Int. Cl.
*B04B 11/05* (2006.01)
*B04B 11/06* (2006.01)
*B04B 11/00* (2006.01)

(58) Field of Classification Search
USPC ..... 494/56, 57
See application file for complete search history.

(56) References Cited

U.S. PATENT DOCUMENTS 3,910,489 A * 10/1975 Uden ..... B04B 11/04
494/27
2015/0148213 A1 5/2015 Chezaud et al.

FOREIGN PATENT DOCUMENTS

FR 2 400 961 A1 3/1979
FR 2 992 574 A1 1/2014

* cited by examiner

CENTRIFUGE MACHINE HAVING AN IMPROVED DISCHARGE SYSTEM

The subject of this invention is a centrifugal machine provided with an improved discharge system.

It may greatly enhance any machine of this kind, especially by performing two-phase centrifugal settling, whereby one of the phases is first directed into a collecting chamber, wherein said phase may be fluid, or on the other hand compact and practically solid, and processed mixtures may for example be liquid-solid, liquid-liquid and solid-gaseous.

Some machines are advantageous in that they allow continuous operation through the permanent drawing of phases, even when one such phase is solid. In this case, the solid phase, containing a high proportion of residual liquid has the consistency of a paste or slurry with pseudo-fluid behaviour permitting flow. It is thus possible to produce this "solid" without having to stop the machine in order to disassemble or open the collecting chamber, and continuous supply may also be performed. A new type of centrifugal machine described in French patent application document registered under number 12 56276, was designed to produce a highly dehydrated solid (<20% residual liquid). The present invention may improve this equipment so as to enable the production of a dense solid and highly dehydrated compact, while being able to take up others, as has been mentioned. Its main advantage is that it allows for controlling or stopping at will the drawing of a phase having an almost solid compact consistency. The drawing rate is controlled and adjustable, which allows for maintaining the consistency or composition of the material drawn, regardless of variations in the composition of the mixture supplying the machine. This is not possible in the case of rotating bowl centrifugal machines of the prior art where the drawing, when it exists, is carried out through a port that may be open or closed, or by means of manual triggering, but generally requires stopping the machine to move it from one state to another. There is yet another design where the port is controlled by hydraulic pressure from an external pump by a rotating joint, the pressurized fluid passing through the axis of rotation of the bowl, but this design for controlling openings and closures of the port is impractical because of the control fluid that needs to be added; and it does not allow for conveniently adjusting the consistency or the flow rate of the discharged product, due to uncertainties as to the properties of flow output from the rotary bowl and the inertia of the hydraulic switching system.

The main purpose of the invention is to control the characteristics of the product drawn, and in particular to allow for the drawing of a dense compact phase, said phase being strongly dehydrated if desired, by controlling the flow rate, which helps avoid excessive drawing of the light phase, as well as drawing the compact phase only as it becomes sufficiently separated from the light phase. Another purpose of the invention is to do so by means of a control system characterized by its simplicity, requiring very little maintenance and having very good mechanical strength over time, and finally benefiting from very short reaction times. This system must be provided with a centrifuge bowl subjected to high rotational speeds and must not compromise the scalability of the rotary bowl where the centrifugal settling takes place.

A final purpose is to put forward a drawing system that does not disrupt the hydrodynamics of the machine. Drawing of the solid in the peripheral portion, through the piston, does not alter the solid-liquid interface in the bowl volume.

In general form, the invention thus relates to a centrifugal machine with a discharge system, the machine comprising a bowl rotating about an axis, the bowl being delimited by an outer wall enclosing a volume, the discharge system comprising at least one collecting chamber occupying part of the bowl volume, at least one aperture positioned in front of each collecting chamber through the bowl wall, characterized in that the discharge system comprises a piston movable within a cavity of the bowl wall between each port and the respective collecting chamber, and a displacement device of the piston, said means being stationary; in that each piston is provided with a solid section and a transverse aperture; and in that the port is obliquely (i. e. offset) positioned in relation to the collecting chamber, and the transverse aperture is alternately positioned in front of the port and in front of the collecting chamber by the displacement device.

The port being obliquely positioned in relation to the collecting chamber, and the traverse aperture being alternately positioned in front of the port and in front of the collecting chamber, the switching position of the piston allows for the filling and subsequent discharge of the traverse aperture, so that a discontinuous discharge is performed by means of repeated reciprocations of the piston. An invariable volume of material is thus discharged with each back-and-forth movement of the piston, so that the draw rate is no longer dependent on a port opening time, but on the number of these back-and-forth movements. The opening section being perfectly noted, and the closure being subsequently complete, said system with mobile pistons, associated with apertures distributed around the bowl circumference and secured thereto, allows for excellent flow rate control. The displacement device being usually mechanical or possibly magnetically levitated, is equally very reliable and precise in its movements.

The solids removal system may also be a device attached by means of an adapted fixing in the bowl wall and having different patterns from that presented herein.

Pistons may move to remove solids between the collecting chamber and the discharge port, whether by means of translation, translation and rotation, or simply rotation movements.

By thus controlling the draw or discharge rate, the drawn phase may only be drawn as it is formed in the collecting chambers, and separated from the light phase: the composition and compactness of the product drawn can thus be maintained despite possible variations in the composition of the mixture introduced into the bowl; drawing will generally be fairly regular and pseudo-continuous, usually compatible with maintaining continuous supply and with continuous operation of the machine.

According to an important embodiment, the displacement device comprises a ring coaxial with the bowl, wherein the piston is supported on said ring, and at least one actuator displaceable along said axis; the ring being connected either to the actuator or to the piston by means of a bearing link or using magnetic repulsion. The important point of this system is that pistons incorporated into the rotary device are controlled by actuators directly or indirectly fixed by means of bearings or magnetic repulsion, and by a joining ring turning along with the bowl or not, by exerting very low friction, or even no friction on said ring, thus completely or almost eliminating mechanical wear.

The system may include a single piston, or any number of pistons, associated with the equivalent number of discharge ports. The pistons may be advantageously biased to the ring by springs contained in the bowl wall, or by means of any other mechanism.

The collecting chamber may have various shapes, and in particular a section tapering towards the port and thus convergent in shape. The displacing device may comprise a circle of mobile actuators along the mobile axis of the bowl, so as to provide good uniform support to the ring, if said ring exists.

Figure 2:
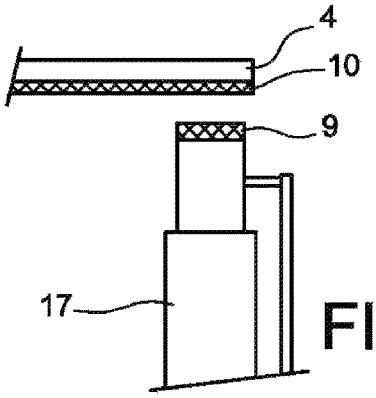
Figure 3:
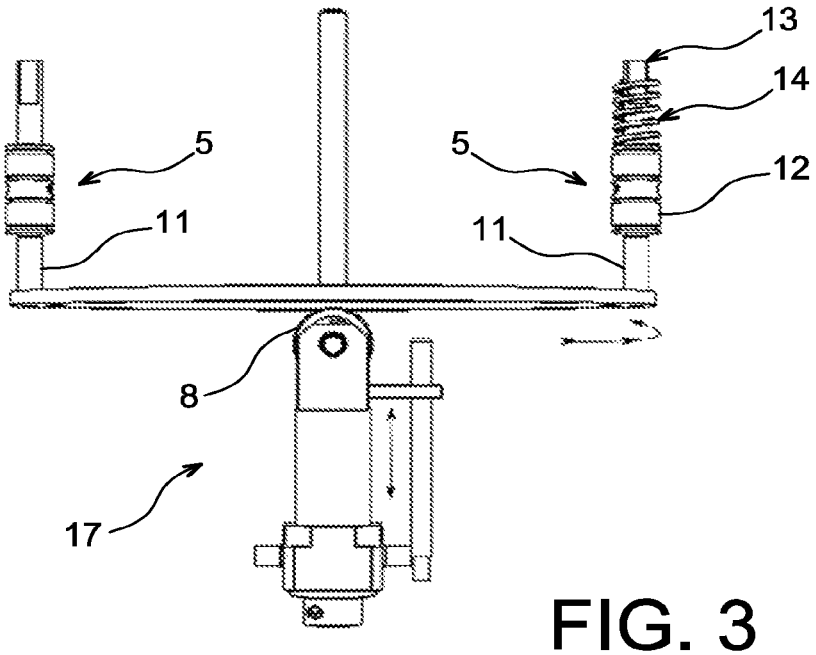
Figure 4:
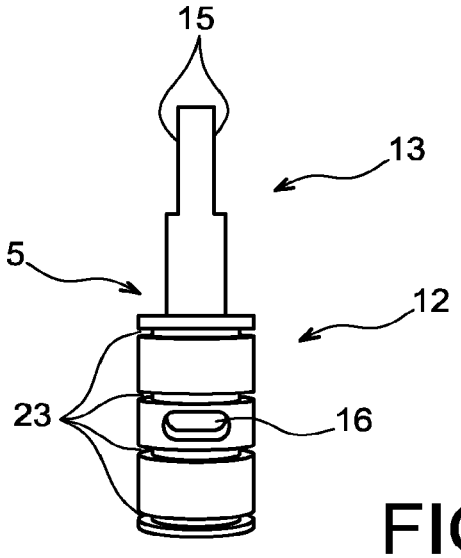
Figure 5:
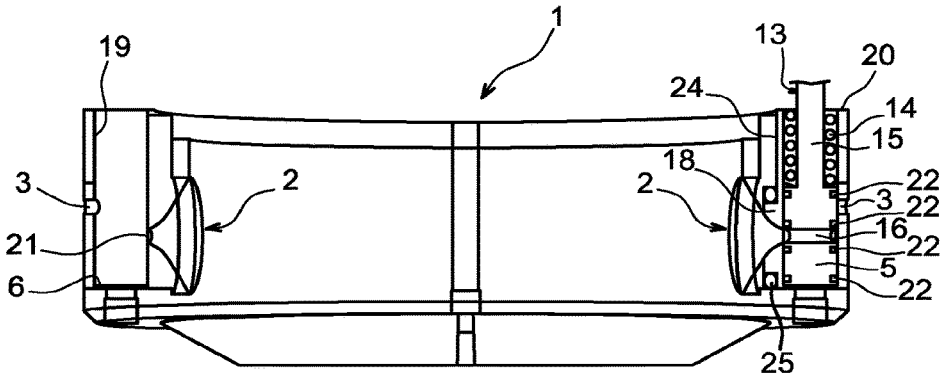
Figure 6:
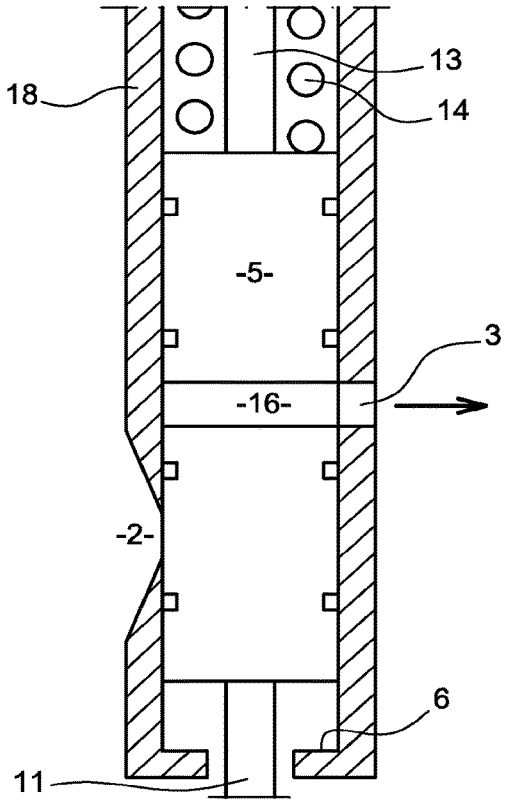

The invention will presently be described with reference to the following figures:

FIG. 1 shows the entire machine;

FIG. 2, an alternative embodiment of the ring support device;

FIG. 3, the device for the opening and closing of ports;

FIG. 4, the pistons;

FIG. 5, the discharge and collecting chambers;

And FIG. 6, the discharge state.

FIG. 1 schematically shows a rotating centrifugal machine equipped with the invention, comprising a rotary bowl 1 rotating about a vertical axis 30, and wherein the fluid, paste, slurry or substantially solid heavy phase, is centrifuged and driven downward by conventional means, such as conical plates widening towards the bottom centre of the bowl 1, and helical blades set within the bowl wall, and present among others in the aforementioned patent application. Collecting chambers 2 are arranged at the bottom of the bowl 1, each communicating with the exterior through a discharge port 3. A ring 4 is arranged below the bowl 1 and actuates the pistons 5 by means of rods 11. Each of the pistons 5 (shown in detail below) is associated with a collecting chamber 2 and several said chambers may be present, at equal height, around the bowl 1, although only a single such chamber is represented here. The ring 4 is rotationally driven with the bowl 1; it is secured to the bowl 1. Stationary actuators 17, fixed to the ground via a bearing 8 (a horizontal axis roller), around a system 7 for driving the bowl 1, transmit vertical movement to the ring 4, thereby enabling the movement of pistons 5. Alternatively, as shown in FIG. 2, but perhaps more preferably, the rod of each actuator 17 may be equipped with a permanent magnet 9, and the underside of the ring 4 with a layer of permanent magnets 10, so as to exert contactless and frictionless repulsion. Alternatively, the permanent magnets 9 may be arranged on a second ring not shown here, present below the ring 4 and secured to the actuators 17.

FIG. 3 is a view showing the pistons 5, the ring 4 and the actuators 17 of the device in isolation. The pistons 5 have a body 12 supported by rods 11, secured to the ring 4, and an upper rod 13 surmounting the body 12, on which for example a spring 14 may be fitted, said spring downwardly pushing the piston 5 and thus maintaining its contact with the ring 4. As seen clearly in FIG. 4, the upper rod 13 also carries flat spots 15 to keep it at a set orientation (in case of translation of the piston 5, other embodiments of the piston and its movement being possible). The body 12 is crossed by a transverse aperture 16, while otherwise having a full section. It is also provided with four grooves 23, two on either side of the aperture 16, for receiving seals 22. Other sealing configurations are possible.

Referring to FIG. 5, collecting chambers 2 are formed in the thickness of the wall 18 of the bowl 1. Their shape here is conical and outwardly convergent. They open into cylindrical cells 19 receiving the pistons 5 (only one piston 5 being shown). A rim 20 above the cells 19 is supported on the flat spots 15 and prevents rotation of the pistons 5, while simultaneously compressing the springs 14. Discharge ports 3 extend between the cells 19 and the exterior. The openings 21 of the collecting chamber 2 in the cells 19 are at a level below the discharge ports 3. Preferably, the system comprising the piston 5 and its surrounding, i.e. a portion of the wall 18, is removable and belongs to a module 24 attached to the rest of the bowl 1, optionally assembled thereto by screwing, wherein a seal 25 is arranged on the connection around the collecting chamber 2, so as to ensure sealability. This attached module allows for the replacement of the piston 5, for example if a new composition of the discharged phase, with different hydrodynamic properties so requires it.

This device is provided with two main positions of the pistons 5:

In the first of these, as shown in FIG. 5, the apertures 16 extend the openings 21 of the collecting chamber 2 and are thus likewise filled with the centrifuged heavy phase in the bowl 1, while the seals 22 present in the grooves 23 prevent said heavy phase from being introduced around the body 12 of the piston 5; the solid sections of the seals 22 obstruct the discharge ports 3; the pistons 5 are then supported on the lower rims 6 of the cells 19, and their support on the ring 4 (by means of the rods 11) is temporarily interrupted;

In the other main position, as shown in FIG. 6, the ring 4 and the piston 5 are raised by the extension of the actuators 17 and the apertures 16 become extensions of the discharge ports 3: centrifugal forces expel their contents towards the exterior, where it is collected; the collecting chambers 2 are however blocked by the solid sections of the body 12. The reverse movements of the piston 5 thus alternately provide for the filling and discharge of the apertures 16, with precise dosage, equal to the volume of the apertures 16, of the amount of material removed; discharge is made possible by the powerful action of the centrifugal field that expels the solid. The apertures 16 thus form discharge chambers determining the discharge volume of material for every order.

The ring 4 may be rotatably immobile, whereby the bearings 8 or the permanent magnets 9 are carried by the pistons 5 or, yet again, are arranged on a second ring parallel to the ring 4. Said bearings or permanent magnets may control the opening and closing of the ports 3 by displacing an intermediate part. They may also be rotationally displaced, rather than by translation. Despite its drawbacks, hydraulic rather than mechanical actuation would be possible. The aperture 16 may be formed by an end or by a lateral notch of the piston 5 or of the intermediate part, rather than forming a central bore. The invention may be applied to any rotating machine performing centrifugation: a cylindrical bowl having, horizontally screwed, etc., for dehydrating solids and/or clarifying fluids.

The invention claimed is:

1. A centrifugal machine comprising:

a discharge system;

a bowl rotating about an axis, the bowl being delimited by an outer wall enclosing a volume;

the discharge system comprising:

at least one collecting chamber occupying a portion of a volume of the bowl, at least one port in front of each collecting chamber through a wall of the bowl, a piston displaceable in a cell of the bowl wall between each port and the collecting chamber respectively, and a displacement device to displace the piston, the displacement device being non-rotatable;

wherein each piston includes a solid section and a transverse aperture; and wherein the port is positioned offset in relation to the collecting chamber, and the transverse aperture is alternately aligned with the port and with the collecting chamber in radial directions relative to the axis through movement of the piston caused by the displacement device.

2. A centrifugal machine according to claim 1, wherein the displacement device comprises a ring coaxial with the bowl, whereby the piston is supported on the ring, and at least one actuator displaceable along the axis; the ring being connected either to the actuator or to the piston by a link using a bearing or a magnetic repulsion.

3. A centrifugal machine according to claim 2, wherein the piston is biased to the ring by a spring contained within the wall of the bowl.

4. A centrifugal machine according to claim 1, wherein the collecting chamber includes a section tapering towards the port.

5. A centrifugal machine according to claim 1, wherein the collecting chamber is recessed in the bowl wall.

6. A centrifugal machine according to claim 1, wherein the piston belongs to a module that is attached to the bowl and that further comprises a portion of the bowl wall.

* * * * *